United States Patent [19]

Rusenko et al.

[11] 4,429,936

[45] Feb. 7, 1984

[54] SPRING JAW FUSE CLIP AND INTEGRALLY RETAINED FUSE PULLER

[75] Inventors: James J. Rusenko, Milwaukee; Marian M. Rzepecki, Brown Deer, both of Wis.

[73] Assignee: Eaton Corporation, Cleveland, Ohio

[21] Appl. No.: 366,437

[22] Filed: Apr. 7, 1982

[51] Int. Cl.[3] ..... H01R 13/633

[52] U.S. Cl. ..... 339/45 R; 337/194; 337/211; 339/46

[58] Field of Search ..... 339/45 R, 46, 219 F, 339/147 P; 337/194, 211, 217

[56] References Cited

U.S. PATENT DOCUMENTS

| | | | |
|---|---|---|---|
| 2,004,314 | 6/1935 | Dante | 337/215 |
| 2,004,327 | 6/1935 | Johansson | 337/215 |
| 2,042,756 | 6/1936 | Wood | 337/245 |
| 3,194,926 | 7/1965 | Ustin | 337/215 |
| 3,518,599 | 6/1970 | Lanux | 337/211 X |
| 3,594,677 | 7/1971 | DeBacker | 337/215 |
| 3,896,408 | 7/1975 | Leidy, Jr. | 339/45 R X |
| 4,288,138 | 9/1981 | Berry et al. | 339/45 R |

FOREIGN PATENT DOCUMENTS

| | | | |
|---|---|---|---|
| 1452714 | 8/1966 | France | 337/211 |

*Primary Examiner*—William R. Briggs

*Attorney, Agent, or Firm*—C. H. Grace; L. G. Vande Zande

[57] ABSTRACT

A spring jaw fuse clip (18) having a backup spring (22) encircling the fuse clip and bearing inwardly upon the outer surfaces of the legs (**18*b*) of the fuse clip, the spring being attached to the fuse clip by engagement of portions (22*d*) thereof with horizontal (18*e*) notches in the edges of the fuse clip legs to prevent displacement of the spring with respect to the clip, and having a insulating fuse puller loop (20) disposed within a pair of slots (18*c*) open to the upper ends of the fuse clip legs for linear movement therein. A rib (20*c*) is provided on the fuse puller loop in the area between the fuse clip legs to prevent tilting or displacement of the fuse puller loop with respect to the fuse clip and to facilitate insertion of the fuse (8) blade therein by camming the legs (18*b*) outwardly to the width of the fuse blade upon being displaced to its outermost position in said clip. A portion (22*b*) of the backup spring (22) extends laterally along one leg of the fuse clip to span the open end of the slot (18*c*) in that leg, thereby to be engaged by the bight portion (20*a***) of the insulating fuse puller loop to limit outward movement of the loop with respect to the fuse clip assembly and thereby to retain the fuse puller integrally assembled therewith.

12 Claims, 5 Drawing Figures

SPRING JAW FUSE CLIP AND INTEGRALLY RETAINED FUSE PULLER

BACKGROUND OF THE INVENTION

This invention relates to spring jaw clips for receiving blade type fuses. In particular it relates to fuse clips of the aforementioned type having a fuse removal device incorporated therewith.

Spring jaw fuse clips for receiving blade type fuses are well known in the art. The contact pressure necessary to affect efficient current transfer between the fuse blade and spring jaws increases in proportion to the size and current rating of the fuse. For large fuses, the amount of pressure from the spring jaws is so substantial as to render insertion or removal of the fuse from the clip extremely difficult. Moreover, upstanding insulating barriers are commonly provided between adjacent fuses to achieve adequate electrical insulation between the adjacent fuses. The space between these barriers and the fuses is relatively small and adds to the difficulty of fuse removal.

Various devices have been provided on or in association with fuse clips to assist in fuse removal, one such device being a bell crank lever pivotally mounted to the fuse clip or to the insulating base to have one leg underly the blade at one end of the fuse. By pivoting the opposite end of the bell crank, the first mentioned leg will pry the fuse blade upwardly from between the spring jaws of the clip. This design has the disadvantage of requiring additional mechanical assembly and provision of additional formations on the base or fuse clip to accommodate the pivotal mounting of the bell crank. Another approach to solving this problem is to provide a fuse puller, or handle, directly on the fuse to project upwardly above the barriers. A disadvantage in this approach is that the fuse puller must be removed from the old fuse and placed onto the new fuse each time a fuse is changed. Still another approach to the problem is to provide a fuse puller in the molded base of the switch or device to which the fuse clip is mounted. Such fuse puller comprises a loop of insulating material guided for vertical movement within guideways molded in the switch base and limited in vertical movement by formations on the base and on the insulating loop. This approach has the disadvantage that each fusible device must be designed to include the guideways and limit stop configuration for the insulating loop fuse puller. Many present design fusible devices lack adequate space for this provision.

SUMMARY OF THE INVENTION

The invention disclosed herein provides a spring jaw fuse clip for a blade type fuse which has a fuse puller integrally mounted therewith and which requires no special modification to accommodate the fuse puller. This fuse clip and puller combination may be used anywhere that a fuse clip without the puller may be used. The puller stays with the fuse clip at all times and therefore need not be removed from or assembled to the fuse when it is changed. No modification of the fuse clip or special assembly operations are required to incorporate the puller with the fuse clip, and the clip is fully usable without the fuse puller.

The invention provides a spring jaw fuse clip having a fuse puller integrally retained thereto which comprises a base, a pair of spaced legs extending upwardly from the base and having transversely aligned vertical slots open to the upper ends of the respective legs, a backup spring engaging outer surfaces of the legs for biasing the legs inwardly, the spring having a portion spanning the respective slot in at least one leg, an insulating loop comprising a planar U-shaped lower portion disposed in the slots transversely of the legs and an upper handle portion extending above the upper ends of the legs, the bight of the U-shaped lower portion extending across the space between the legs and being disposed in proximity to the lower ends of the slots for positioning below the fuse blade inserted between the legs, the bight driving the fuse blade from engagement between the legs when the insulating loop is pulled upwardly and the bight abutting the backup spring at the portion thereof which spans the respective slot to limit upward movement of the insulating loop.

DESCRIPTION OF THE PREFERRED EMBODIMENT

Figure 1:
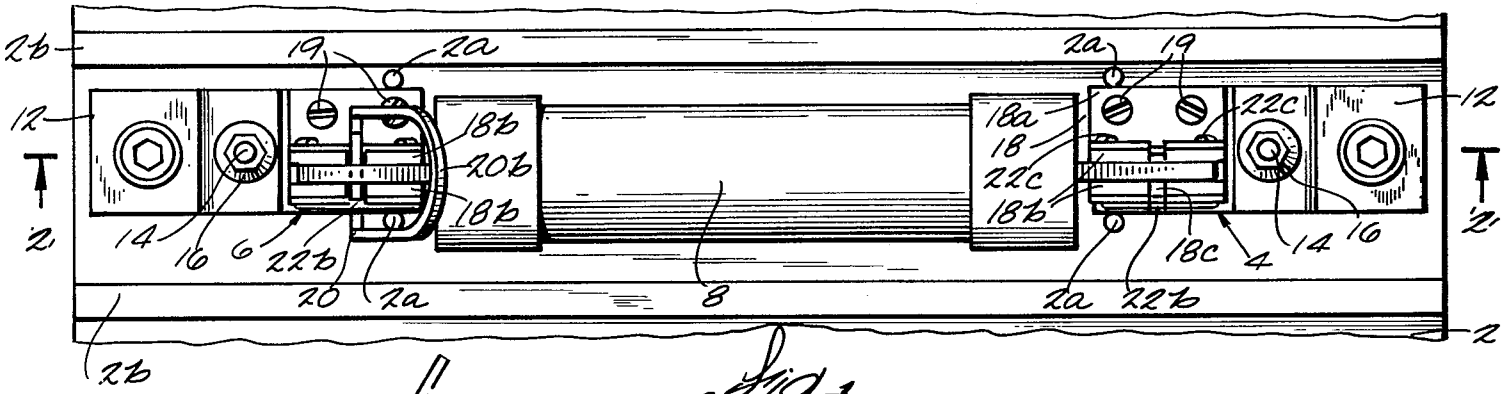
FIG. 1 is a plan view of a fuse holder assembly with a fuse installed incorporating the spring jaw fuse clip and integrally retained fuse puller of this invention.
Figure 2:
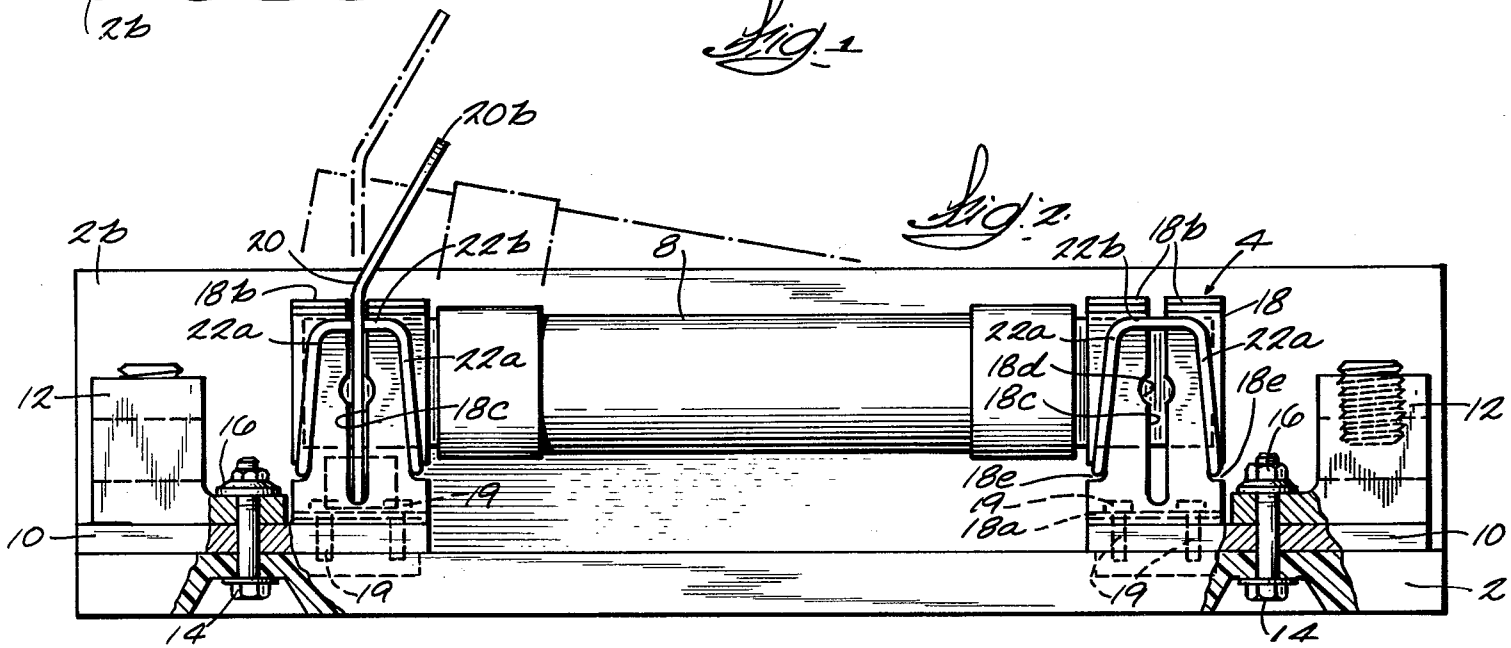
FIG. 2 is a longitudinal sectional view of the fuse holder assembly of FIG. 1 taken substantially along the line 2—2 thereof.

An exemplary embodiment of a fuse holder assembly is shown in FIGS. 1 and 2. An insulating base 2 is provided at opposite ends with fuse clip assemblies 4 and 6 which receive a blade type fuse 8 therebetween. The assembly of FIGS. 1 and 2 represents one phase of a multi-phase protected circuit device which would have similar fuse holder assemblies for each phase and located on opposite sides of that assembly shown in the drawings. For simplification of the description, the base 2 is broken away on opposite sides of the fuse holder assembly and only the single assembly will be described.

The right-hand fuse clip assembly 4 comprises a connector plate 10 and a pressure type wiring connector 12 secured to the right-hand end of base 2 by a bolt 14 extending upwardly through aligned holes in the base 2, connector plate 10 and connector 12 to receive a conical washer and nut assembly 16 at the upper or front side of connector 12. Suitable provisions are made to establish correct longitudinal alignment between the right-hand fuse clip assembly 4 and the left-hand fuse clip assembly 6. For example, base 2 may be provided with upstanding bosses 2*a* (FIG. 1) disposed on opposite sides of the connector plate 10 to cooperate with the bolt 14 for establishing proper alignment of the assembly 4. A spring jaw fuse clip 18 completes the fuse clip assembly 4. The clip 18 has a base portion which is positioned upon the upper surface of connector plate 10 and includes an offset mounting foot portion 18*a*. A pair of clearance holes are provided in mounting foot 18*a* to receive thread cutting screws 19 which threadably engage aligned holes in connector plate 10 to secure fuse clip 18 to the connector plate 10. Base 2 is provided with a recess in proximity to the aligned holes in plate 10 to permit the screws 19 to project below the connector plate 10.

Figure 3:
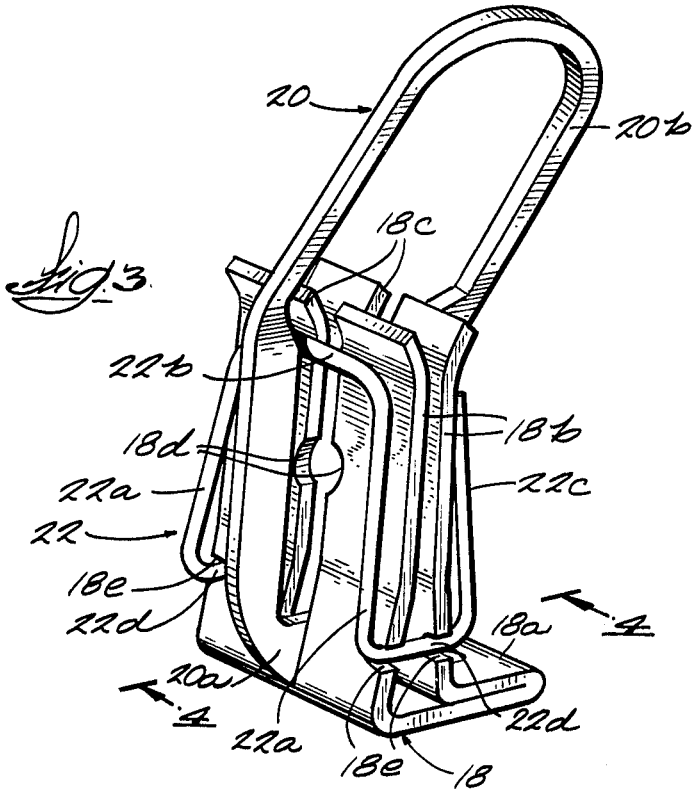
FIG. 3 is a perspective view of the spring jaw fuse clip and integrally retained fuse puller of this invention.
Figure 4:
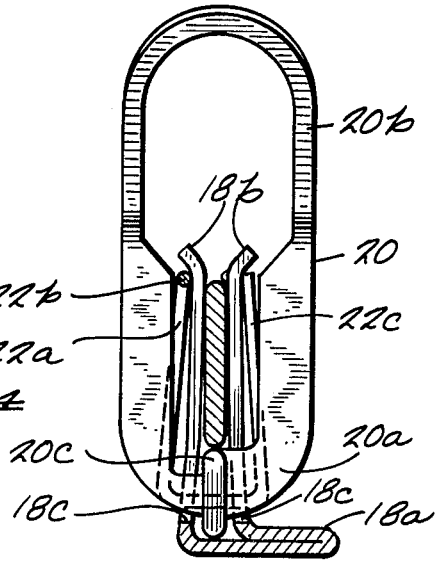
FIG. 4 is a cross-sectional view of the fuse clip of FIG. 3 taken substantially along the line 4—4 of FIG. 3 and showing a fuse blade installed therein.

Fuse clip 18 has a pair of spaced legs 18*b* which are formed upwardly from the base portion as may best be seen in FIGS. 3 and 4. The fuse clip illustrated in FIGS. 3 and 4 includes a fuse puller member 20, but the fuse clip per se is the same at either end of the assembly. The legs 18*b* converge in the upward direction to provide a spring biased gripping engagement with a blade inserted therebetween. The upper or free ends of legs 18*b* may be flared outwardly to facilitate insertion of a fuse blade therebetween. Each leg 18*b* contains a centrally located vertical slot 18*c* which effectively bifurcates the leg into two individual contact segments for enhanced engagement with a fuse blade inserted therein. Near the vertical midpoint of the legs 18*b*, the slot 18*c* is provided with arcuate recesses 18*d* which define a cylindrical opening in each leg for purposes of receiving a Class R fuse pin in a manner well known to those skilled in this art. Near the base of the fuse clip the legs 18*b* are provided at their outer edges with aligned notches 18*e* which are formed inwardly at right angles to the edge of the legs 18*b*.

A backup spring 22 is assembled to the fuse clip 18 to encircle the fuse clip and bear inwardly upon the outer surfaces of the legs 18*b* near their upper end. The spring 22 provides additional inward bias for the legs 18*b* and functions to limit outward movement of the legs 18*b* beyond a critical elastic limit thereof due to abnormal forces which may be exerted on the legs. The spring 22 comprises a first inverted U-shaped segment comprising a pair of upwardly extending legs 22*a* joined at their upper ends by a bight portion 22*b* which engages the respective leg 18*b* at a point just below the outward flare of the leg 18*b* and spans the slot 18*c* in that leg. At the opposite side of fuse clip 18, the spring 22 comprises a pair of upstanding legs 22*c* which are formed as a mirror image of legs 22*a* but which do not have a connecting bight portion at the upper ends thereof. The lower ends of legs 22*a* and 22*c* are joined by transversely extending horizontal segments 22*d*. Segments 22*d* are received within the aligned notches 18*e* to locate and retain the spring 22 assembled to the fuse clip 18.

Figure 5:
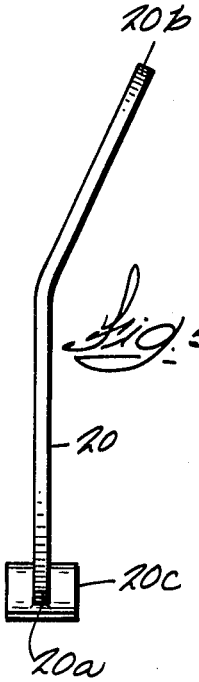
FIG. 5 is a side elevational view of the fuse puller of this invention.

The fuse clip assembly 6 at the left-hand end of the fuse holder assembly shown in FIGS. 1 and 2 comprises essentially the identical components as the fuse clip assembly 4 at the right-hand end, but additionally includes a fuse puller member 20 assembled to the fuse clip 18. The connector plate 10 of the fuse clip assembly 6 is reversely oriented with respect to the same plate for the assembly 4 in order to provide the holes for thread cutting screws 19 to be aligned on the same side of the longitudinal center line of the fuse assembly as are those for the fuse clip assembly 4. Referring additionally to FIGS. 3 through 5, the fuse puller 20 comprises a molded insulating loop 20 which is essentially a flat or planar member disposed within the slots 18*c* of the fuse clip 18. The lower portion of puller 20 is essentially U-shaped, the bight portion 20*a* thereof extending transversely between the legs 18*b* and extending out opposite sides thereof through the slot 18*c*. The thickness of loop 20 is nominally less than the width of slots 18*c* to guide the loop 20 for vertical movement within the slots. The height, or vertical dimension, of bight 20*a* cooperates with the width of slots 18*c* and the thickness of the loop to maintain vertical orientation of puller loop 20*a* with respect to the fuse clip 18, preventing it from pivoting or rocking over in the plane containing the longitudinal dimension of the fuse. Moreover, the height of bight 20*a* is greater than the diameter of the rejection pin opening formed by arcuate recesses 18*d*, preventing the loop from pivoting in the pin opening and thereby rocking over in the aforementioned plane when the loop is raised to align the bight with the pin opening. A handle portion 20*b* of the loop is angularly offset out of the plane of the lower portion.

A vertically oriented rib 20*c* is centrally disposed on bight 20*a* to extend in opposite directions therefrom. The length of rib 20*c*, i.e. in the longitudinal direction of the fuse, is greater than the thickness of slots 18*c* to retain the lower portion of loop 20 centered between the legs 18*b*, thereby preventing the lower end of the loop 20 from skewing out to either side of the clip 18. The transverse thickness of rib 20*c* is nominally less than the corresponding thickness of a fuse blade to be received by the clip, and is preferably less than the space between the legs 18*b* at their wider base portion so as to be loosely engaged by the interior surfaces of the legs at the upper edge of the rib when the loop is in its lowest position within the slots 18*c*. This engagement maintains the loop 20 vertically oriented with respect to the clip 18 to prevent the upper end of the loop from rocking, or tipping over, transversely of the clip 18. In the lowest position of loop 20, the bottom edge of rib 20*c* also engages with the base of clip 18 to further aid in maintaining the loop 20 oriented vertically in the longitudinal direction.

The loop 20 may be pulled upwardly within the slots 18*c* by means of the handle 20*b*. Upward travel of the loop is limited by engagement of the left-hand side of bight 20*a* (FIG. 4) with the portion 22*a* of backup spring 22 which spans the slot 18*c* in the left-hand leg 18*b* of the clip. To obtain maximum upward travel of loop 20 in the clip, the portion of bight 20*a* to the left of rib 20*c* (FIG. 4) is recessed below the height of bight 20*a* on the right side of rib 20*c*. Although loop 20 is primarily a fuse puller, as will be described more fully hereinafter, it also serves to faciliate insertion of a fuse blade into the clip. By pulling handle portion 20*b*, the loop 20 is moved to its upward limit position whereby the rib 20*c* cams the blades 18*b* apart to the approximate dimension of the fuse blade. The latter may thereby be easily inserted without requiring the penetrating edge of the blade to initially cam the legs 18*b* apart. As the blade is inserted, it drives the loop 20 to its lower position in the clip.

Referring again to FIGS. 1 and 2, the base 2 is provided with a pair of vertically upstanding ribs 2*b* which may extend along the entire fuse assembly or may extend only in the areas of the fuse clip assemblies 4 and 6 as desired. Such ribs are provided to increase the over the surface distance between adjacent fuse holder assemblies to achieve the necessary insulation requirements for devices of the type employing such fuse holder assemblies. The ribs 2*b* are spaced closely to the fuse in order to render the device as compact as possible, and do not permit a large amount of access to the sides of the fuse for removal thereof. For this purpose the fuse puller 20 has been incorporated in the fuse clip 18 of the left-hand fuse clip assembly 6 which is the line side of the fusible device. The fuse clip 18 is oriented with respect to the fuse assembly such that the offset upper handle portion 20*b* is angularly disposed toward the opposite end of the fuse assembly to overlie the fuse 8. The line side end of fuse 8 may be removed from fuse clip assembly 6 by pulling upwardly on the handle portion 20*b* of puller 20 to cause the upper surface of rib 20*c* to engage the lower surface of the fuse blade and drive it upwardly out of engagement with the legs 18*b* of the fuse clip as shown in dotted lines in FIG. 2. When the line side end of the fuse 8 is pivoted out of the fuse clip 18, the upper portion of puller 20 may be deflected free of the end of the fuse blade and the fuse then pivoted further in the clockwise direction as viewed in FIG. 2 to enable the workman to subsequently pull the other end free from fuse clip assembly 4. It is a common practice for fuse holder assemblies to be vertically oriented as opposed to the horizontal orientation shown in the drawings in FIGS. 1 and 2. When vertically oriented, the line side fuse clip assembly 6 is customarily disposed at the upper end of the fuse assembly. In this orientation, the angular displacement of the puller handle portion 20*b* serves also to prevent the fuse from falling completely out of the device in the event that the blade is freed from the fuse clip with unexpected momentum.

The spring jaw fuse clip with integrally retained fuse puller described in the foregoing specification represents a simple, economical approach to providing a fuse puller for fusible devices. The fuse puller disclosed herein facilitates both insertion and removal of the fuse. The offset handle portion of the puller serves as a retainer for the fuse to prevent the fuse from falling completely out of the fusible device during removal. While a single and preferred embodiment of the spring jaw fuse clip with integrally retained fuse puller has been disclosed herein, it is to be understood that this invention is susceptible of various modifications without departing from the scope of the appended claims.

We claim:

1. A spring jaw fuse clip and a fuse puller integrally retained thereto comprising, in combination:

a base;

a pair of spaced legs extending upwardly from said base and having transversely aligned vertical slots open to the upper ends of the respective legs;

a backup spring engaging outer surfaces of said legs for biasing said legs inwardly, said spring having a portion spanning the respective slot in at least one leg;

an insulating loop comprising a planar U-shaped lower portion disposed in said slots transversely of said legs and an upper handle portion extending above the upper ends of said legs, the bight of said U-shaped lower portion extending across the space between said legs and being disposed in proximity to lower ends of said slots for positioning below a fuse blade inserted between said legs, said bight driving the fuse blade from engagement between said legs when said insulating loop is pulled upwardly, and said bight abutting said backup spring at said portion thereof spanning said respective slot to limit upward movement of said insulating loop.

2. The invention according to claim 1 wherein means are provided on said legs for cooperative engagement by said backup spring for preventing upward movement of said spring relative to said clip.

3. The invention according to claim 2 wherein said means comprise horizontal notches in the outer edges of said legs and said spring has connecting portions extending across the space between said legs, said connecting portions being disposed within said notches.

4. The invention according to claim 1 wherein the bight of said planar lower portion has a vertical dimension which is substantially greater than the width of said slots whereby to maintain said insulating loop vertically oriented with respect to said fuse clip.

5. The invention according to claim 4 wherein said slots have arcuate recesses which cooperate to define aligned openings for receiving a rejection pin therein, and the height of said bight portion is greater than the diameter of said openings defined by said recesses to prevent said insulating loop from pivoting about said bight portion within said openings.

6. The invention according to claim 5 wherein said bight is vertically recessed at the portion thereof which engages said backup spring to afford additional upward travel for said insulating loop within said slots.

7. The invention according to claim 1 wherein said bight comprises a rib projecting from the planar surface of said bight and positioned between said legs of said fuse clip for laterally positioning said planar lower portion on said fuse clip.

8. The invention according to claim 7 wherein said rib is vertically oriented having a greater height than width, the width of said rib being less than the space between said legs at the base of said fuse clip for loosely engaging the interior surfaces of said legs when said rib is adjacent said base for restricting lateral pivotal displacement of the upper portion of said insulating loop with respect to said fuse clip.

9. The invention according to claim 8 wherein said rib projects from opposite surfaces of said bight.

10. The invention according to claim 9 wherein the lower edges of said rib engages the base of said fuse clip when said insulating loop is in the lower-most position with respect to said fuse clip to cooperate with said bight within said slots to maintain said insulating loop vertically oriented with respect to said fuse clip.

11. The invention according to claim 9 wherein said rib cams said legs apart when said insulating loop is pulled to its upper limit position, the width of said rib being nominally less than the thickness of a fuse blade to be received by said fuse clip to facilitate insertion of said fuse blade into said fuse clip.

12. The invention according to claim 1 wherein said handle portion is offset in an angular plane in the direction of the body of a fuse to be inserted in said fuse clip to overlie the blade of said fuse received by said fuse clip.

* * * * *